US010634449B2

(12) United States Patent
Sullivan

(10) Patent No.: US 10,634,449 B2
(45) Date of Patent: Apr. 28, 2020

(54) AIR ACTUATED MAGAZINE FOR PROJECTILE LOADER

(71) Applicant: United Tactical Systems, LLC, Lake Forest, IL (US)

(72) Inventor: Brian Edward Sullivan, Alta Loma, CA (US)

(73) Assignee: United Tactical Systems, LLC, Lake Forest, IL (US)

( * ) Notice: Subject to any disclaimer, the term of this patent is extended or adjusted under 35 U.S.C. 154(b) by 0 days.

(21) Appl. No.: 16/250,574

(22) Filed: Jan. 17, 2019

(65) Prior Publication Data

US 2019/0226795 A1 Jul. 25, 2019

Related U.S. Application Data

(60) Provisional application No. 62/619,469, filed on Jan. 19, 2018.

(51) Int. Cl.
*F41B 11/00* (2013.01)
*F41B 11/55* (2013.01)
*F41B 11/54* (2013.01)

(52) U.S. Cl.
CPC ..... *F41B 11/55* (2013.01); *F41B 11/54* (2013.01)

(58) Field of Classification Search
CPC ..... F41B 11/50; F41B 11/54
See application file for complete search history.

(56) References Cited

U.S. PATENT DOCUMENTS

| | | | |
|---|---|---|---|
| 4,487,103 | A | 12/1984 | Atchisson |
| 4,658,700 | A | 4/1987 | Sullivan |
| 5,905,224 | A | 5/1999 | Jordan |
| 8,839,706 | B1 | 9/2014 | Macy |
| 9,429,385 | B1 | 8/2016 | Allen |
| 2007/0107592 | A1 | 5/2007 | Snow |
| 2007/0151440 | A1 | 7/2007 | Cook |
| 2010/0293830 | A1 | 11/2010 | Winge |

OTHER PUBLICATIONS

International Search Report issued to PCT/US2018/13871, dated May 14, 2018 (2 pages).
Written Opinion of International Searching Authority issued to PCT/US2018/13871, dated May 14, 2018 (5 pages).

*Primary Examiner* — John A Ricci
(74) *Attorney, Agent, or Firm* — Barnes & Thornburg LLP

(57) ABSTRACT

A magazine for a high capacity loader for sequentially loading a plurality of projectiles into a launcher. The magazine has a magazine housing for holding a plurality of projectiles. The magazine housing has an opening providing access to a projectile chimney. The projectiles exit the magazine through the opening in the magazine housing via the projectile chimney. An aperture is provided in a sidewall of the projectile chimney and the aperture leads to a piston chamber. A pneumatically actuated actuator is provided in the piston chamber. The pneumatically actuated actuator drives an indexing assembly for the launcher.

20 Claims, 9 Drawing Sheets

AIR ACTUATED MAGAZINE FOR PROJECTILE LOADER

CROSS-REFERENCE TO RELATED APPLICATIONS

This application claims the benefit of U.S. Provisional Patent Application No. 62/619,469, filed Jan. 19, 2018, which is expressly incorporated herein by reference and made a part hereof.

FEDERALLY SPONSORED RESEARCH OR DEVELOPMENT

Not Applicable.

TECHNICAL FIELD

The present disclosure relates generally to a projectile loader for guns, and more specifically to an air actuated magazine for a projectile loader.

BACKGROUND

Projectile loaders for guns and magazines for projectile loaders for guns, and specifically paintball guns and other frangible projectile launchers, are well known in the art. While such projectile loaders and magazines for such projectile loaders according to the prior art provide a number of advantages, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY

According to one embodiment, the disclosed subject technology relates to a high capacity loader for sequentially loading a plurality of projectiles into a launcher.

The disclosed subject technology further relates to a magazine for a high capacity loader, comprising: a magazine housing for holding a plurality of projectiles, the magazine housing having an opening providing access to a projectile chimney, the plurality of projectiles exiting the magazine through the opening in the magazine housing via the projectile chimney; an aperture in a sidewall of the projectile chimney, the aperture leading to an air pathway; a piston chamber in fluid communication with the air pathway; an actuator in the piston chamber, the actuator having a piston at a first end thereof; and, an indexing assembly in the magazine housing, the indexing assembly being driven by the actuator.

The disclosed subject technology further relates to a magazine for a high capacity loader, comprising: a magazine housing for holding a plurality of projectiles, the magazine housing having an opening providing access to a projectile chimney, the plurality of projectiles exiting the magazine through the opening in the magazine housing via the projectile chimney; an aperture in the projectile chimney; a piston chamber in fluid communication with the aperture; and, an air actuator in the piston chamber, the air actuator having a piston at a first end thereof, wherein the air actuator drives an indexing assembly for indexing the plurality of projectiles in the high capacity loader.

The disclosed subject technology further relates to a magazine for a high capacity loader, comprising: a magazine housing for holding a plurality of projectiles, the magazine housing having an opening providing access to a projectile chimney, the plurality of projectiles exiting the magazine through the opening in the magazine housing via the projectile chimney; an aperture leading to a piston chamber; a pneumatically actuated actuator in the piston chamber, the actuator having a piston at a first end thereof; an indexing assembly in the magazine housing, the indexing assembly being driven by the actuator; and, a first drive core indexed by the indexing assembly, wherein the high capacity loader is adapted to be connected to a launcher.

The disclosed subject technology further relates to a magazine for a high capacity loader, wherein the actuator is moveable between a first position and a second position.

The disclosed subject technology further relates to a magazine for a high capacity loader, wherein the indexing assembly indexes the plurality of projectiles when the actuator is moved to the second position.

The disclosed subject technology further relates to a magazine for a high capacity loader, wherein the indexing assembly is connected to a second end of the actuator.

The disclosed subject technology further relates to a magazine for a high capacity loader having a spring exerting a force on the actuator away from the indexing assembly.

The disclosed subject technology further relates to a magazine for a high capacity loader, wherein the spring biases the actuator to the first position.

The disclosed subject technology further relates to a magazine for a high capacity loader, wherein the aperture is provided in a sidewall of the projectile chimney.

The disclosed subject technology further relates to a magazine for a high capacity loader having a grate within the aperture in the sidewall of the projectile chimney.

The disclosed subject technology further relates to a magazine for a high capacity loader having a flange extending from the magazine housing, the flange mating with a barrel of a launcher to which the magazine is attached.

The disclosed subject technology further relates to a magazine for a high capacity loader, wherein the actuator is pneumatically actuated The disclosed subject technology further relates to a magazine for a high capacity loader, wherein the air actuator is moveable between a first position and a second position, and further comprising a spring exerting a force on the air actuator to bias the actuator to the first position.

The disclosed subject technology further relates to a magazine for a high capacity loader having a second drive core core rotationally connected to the first drive core and indexed by the indexing assembly.

The disclosed subject technology further relates to a magazine for a high capacity loader having a spring exerting a force on the actuator to bias the actuator away from the indexing assembly.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example, with reference to the accompanying drawings in which embodiments of the disclosures are illustrated and, together with the descriptions below, serve to explain the principles of the disclosure.

DETAILED DESCRIPTION

Figure 1:
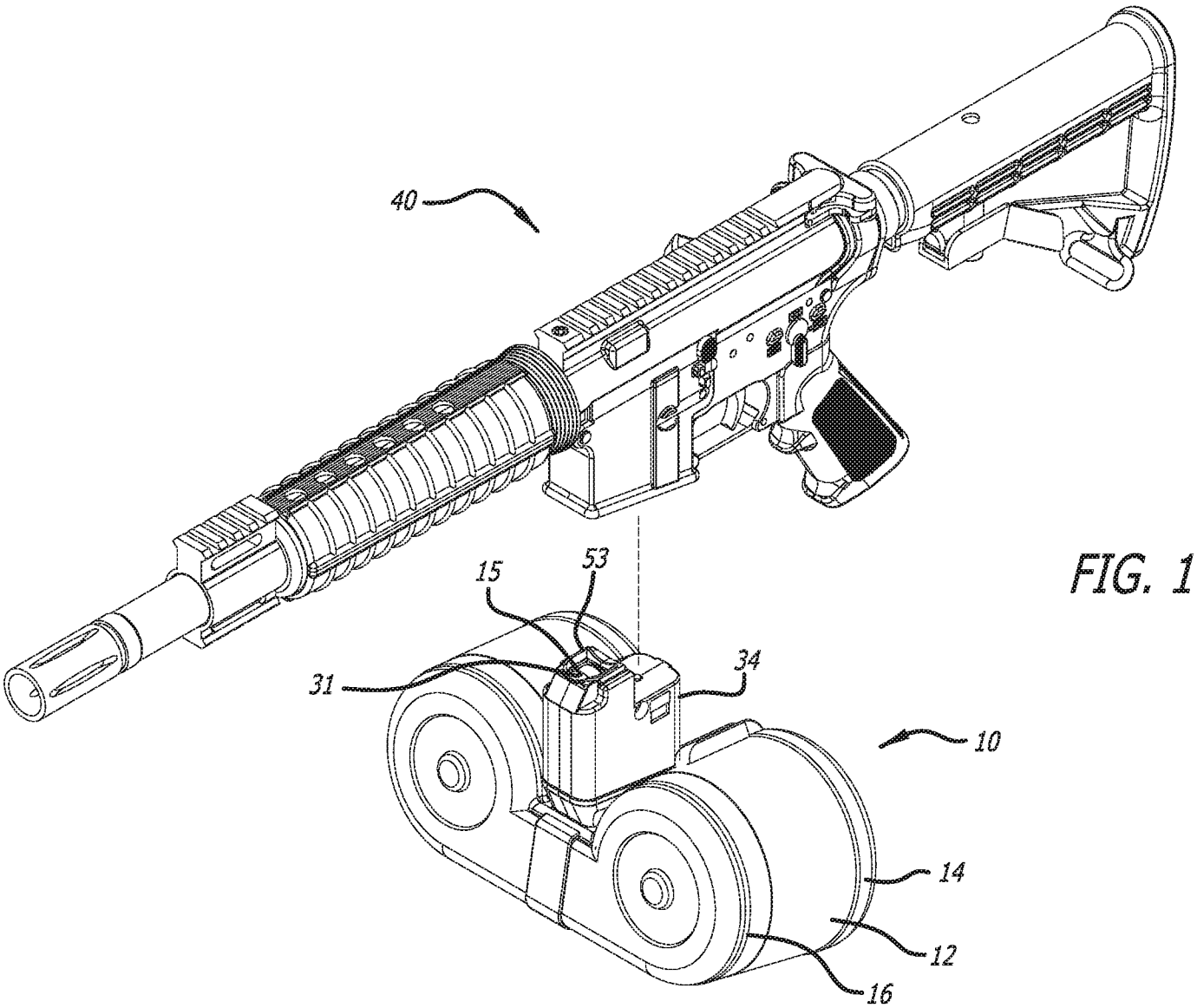
FIG. 1 is a front perspective view of a projectile loader and magazine for connection to a launcher according to one embodiment.

While the high capacity projectile loader and magazine therefor discussed herein is susceptible of embodiments in many different forms, there is shown in the drawings, and will herein be described in detail, preferred embodiments with the understanding that the present description is to be considered as an exemplification of the principles of the high capacity projectile loader and magazine therefor, and is not intended to limit the broad aspects of the disclosure to the embodiments illustrated.

Figure 2:
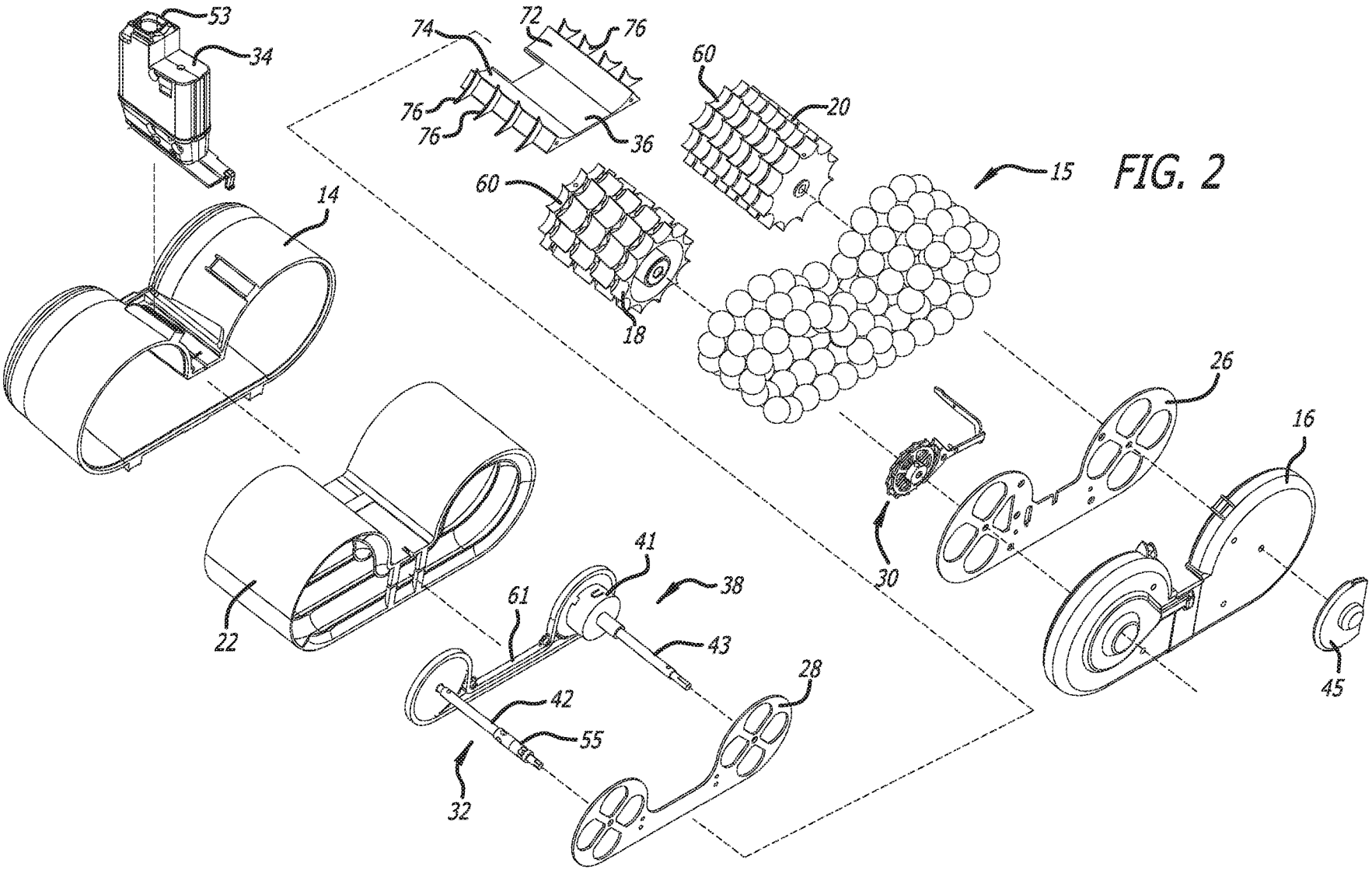
FIG. 2 is an exploded rear perspective view of the projectile loader and magazine of FIG. 1 according to one embodiment.
Figure 3:
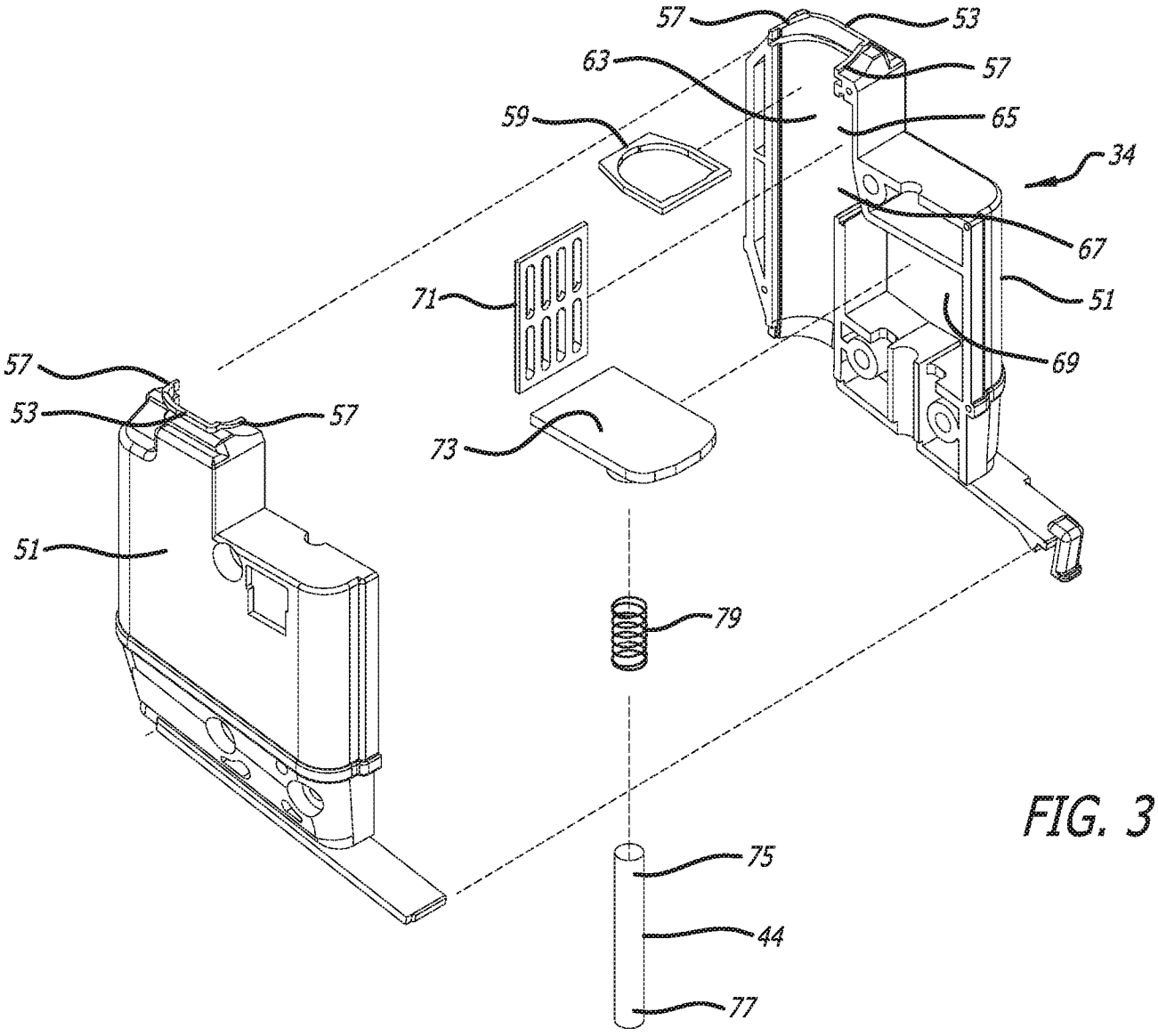
FIG. 3 is an exploded rear perspective view of the magazine of FIGS. 1 and 2.

Referring now to the figures, and initially to FIGS. 1-3, in one embodiment there is shown a high capacity projectile loader 10 for loading projectiles 15 into a gun or launcher 40, such as a paintball gun or frangible projectile launcher. The high capacity projectile loader 10 can handle a large amount of projectiles 15, such as for example 100 projectiles or more. Additionally, the high capacity loader 10 is able to accept different shaped projectiles. For example, the loader 10 can accept standard round projectiles, and the same loader 10 can accept projectiles that have both a cylindrical and a semi-hemispherical shape, as well as additional alternate shapes. Additionally, because the projectile loader does not place stress or loads on the projectiles in the load path, the loader can operate with both rigid and non-rigid projectiles.

As shown in the figures, the loader 10 generally comprises an outer housing 12, which may include a front outer housing 14 connected to a rear outer housing 16, a first drive core 18, a second drive core 20, a divider 22 to retain the projectiles in a defined load path around the first and second drive cores 18, 20, a rear plate 26 at a rear (or second end) of the drive cores 18, 20, a front plate 28 at a front (or first end) of the drive cores 18, 20, an indexing assembly 30 adjacent the second end of the drive cores 18, 20, a drive assembly 32 adjacent a first end of the drive cores 18, 20, a magazine 34, and a loader plate 36. In one embodiment the divider 22 comprises a spring (not shown) around the two drive cores 18, 20 to define the load paths, and a sleeve (not shown) around the spring. In another embodiment, the divider 22 comprises an inner housing having divider members or channel guides that define the load path around the two drive cores 18, 20.

Figure 6:
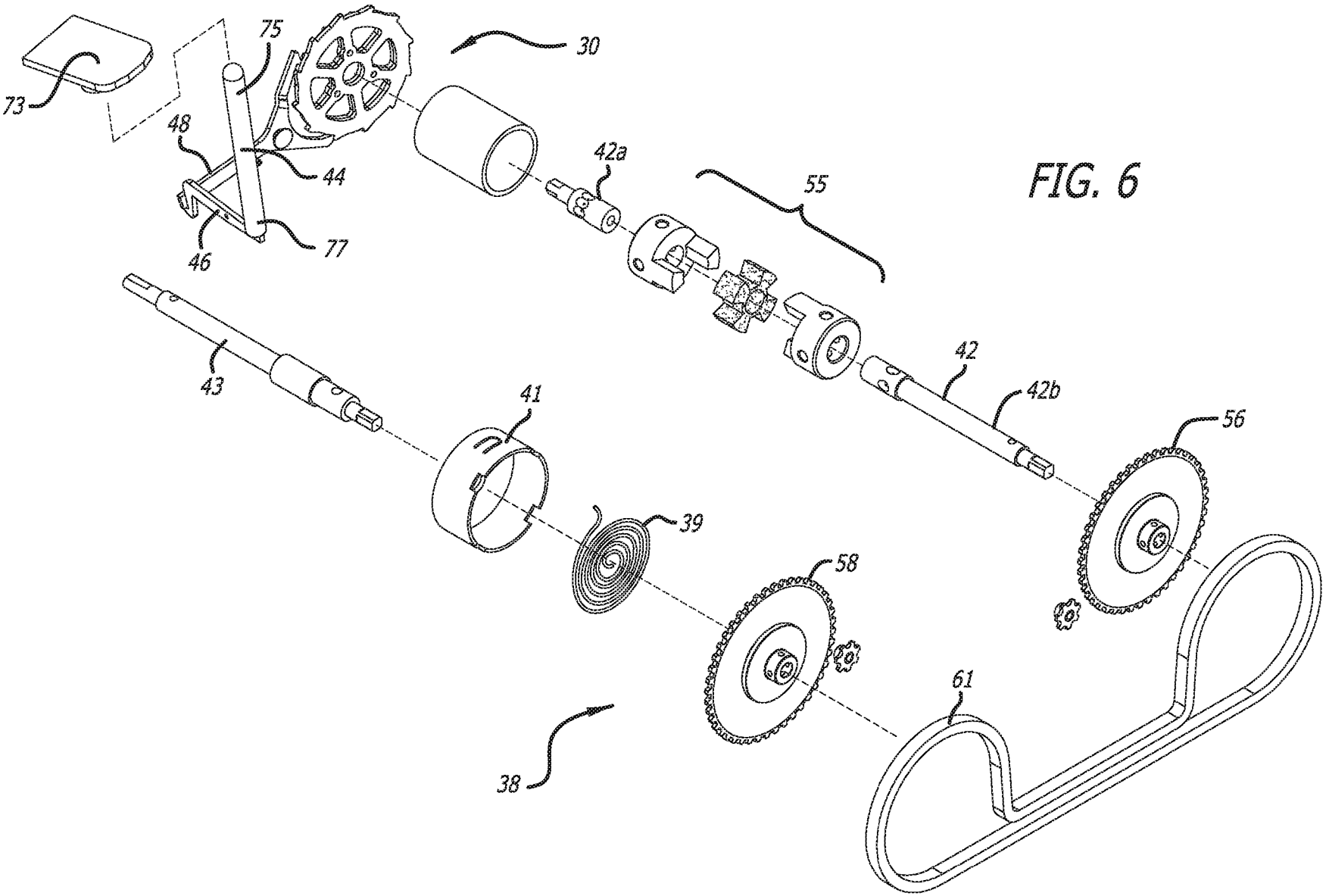
FIG. 6 is a partial front exploded perspective view of the drive assembly and indexing assembly for the projectile loader and magazine of FIG. 1 according to one embodiment.

The loader 10 is typically pre-tensioned by a user, for example by turning a pre-tensioning mechanism 38, such as shown in FIGS. 2 and 6. Following the pre-tensioning, when the projectiles 15 are loaded into the loader 10 the crank 45 is turned to fully load the spring 39 the proper amount for the number of projectiles 15 inserted into the loader 10. Accordingly, the pre-tensioning mechanism 38 can also be referred to as a force loading mechanism 38. In one embodiment the pre-tensioning mechanism 38 comprises a spring 39, such as a clock spring 39 or other internal coil spring, that has one end connected to the second shaft 43 and the other end connected to a drum 41 positioned around the clock spring 39. The drum 41 is fixed to the front plate 28 and does not rotate. Accordingly, when the second shaft 43 is rotated with the crank 45, which occurs during both pretensioning and loading of the loader, the clock spring 39 will be placed under tension and will exert a force to rotate the drive cores 18, 20 to operate the loader 10 in use. In one embodiment, the pre-tensioning mechanism 38 is directly connected to the second drive shaft 43 and is indirectly connected to the first drive shaft 42 with a drive belt 61 or drive chain 61. The pre-tensioning mechanism 38, and specifically the spring 39, is further loaded during insertion of the projectiles into the loader 10 as part of the force loading mechanism operation. Specifically, as the projectiles are loaded into the loader 10, in the reverse order that they are dispensed, the crank 45 must be rotated to rotate the drive cores 18, 20 in the opposite rotational direction as when they rotate to dispense the projectiles. By rotating the crank 45 in the opposite direction as the direction of dispensing, the spring 39 is loaded a sufficient amount for the number of projectiles inserted into the loader.

As shown in FIG. 1 the loader 10 is designed to connect to a gun/launcher via the magazine 34 for delivering the projectiles into the breach of the launcher. Different magazines 34, each designed for connection to a specific launcher and/or for a different output from the launcher 40, can be connected to the same loader 10 so that a single loader 10 can be connected to different launchers. Additionally, the loader 10 is designed to accommodate different firing systems of different launchers (e.g., mechanical, pneumatic or electronic) and different loader actuation systems. The embodiment shown herein provides for a contactless or non-contact actuation system. Accordingly, as shown in FIGS. 3-4 and 7-9, the indexing assembly 30 in the embodiment shown receives a contactless input from the launcher 40 during each firing of a projectile from the launcher to index the loader 10 one projectile. The output provided by the launcher 40, and the corresponding input received by the magazine, as described herein, is a pneumatic contactless output/input.

In one embodiment, the first and second drive cores 18, 20 are supported by shafts retained by the rear plate 26 at a rear (or second end) of the drive cores 18, 20, and a front plate 28 at a front (or first end) of the drive cores 18, 20. Specifically, in one embodiment the first drive core 18 is supported by a first drive shaft 42 and the second drive core 20 is supported by a second drive shaft 43. The second drive shaft 43 has the pre-tensioning mechanism 38 connected thereto, and the first drive shaft 42 has the indexing assembly 30 connected thereto. Accordingly, in one embodiment, the input force to rotate the first and second drive shafts 42, 43 is provided by the pre-tensioning mechanism 38, and the timing for such rotation is provided by the indexing assembly 30. In one embodiment, the indexing assembly 30 receives an input from the launcher 40, such as a mechanical input from the bolt assembly of the launcher 40. However, in alternate embodiments where a mechanical input from the launcher 40 is not available, for example, where the loader 10 is being retrofit on a launcher 40 that was not designed to provide a mechanical input, a non-mechanical or contactless input must be accepted by the loader 10 and converted into a mechanical input.

As shown in FIGS. 3-4 and 6-9, in various embodiments, the indexing assembly 30 is a ratchet mechanism comprising an actuator 44 that receives the input from the launcher 40, a lower link 46 connected to the actuator 44, a first pawl 48 connected to the lower link 46, wherein the first pawl 48 drives an outer cog 50, a second pawl 52 connected to the first pawl 48, and wherein the second pawl 52 operates as a stop for an inner cog 54 that is fixed to the outer cog 50. Rather than receiving a mechanical input from the launcher 40 as in prior embodiments, the air actuated actuator 44 of the current embodiment receives a contactless input. In one embodiment, the contactless input is a pneumatic input.

Figure 4:
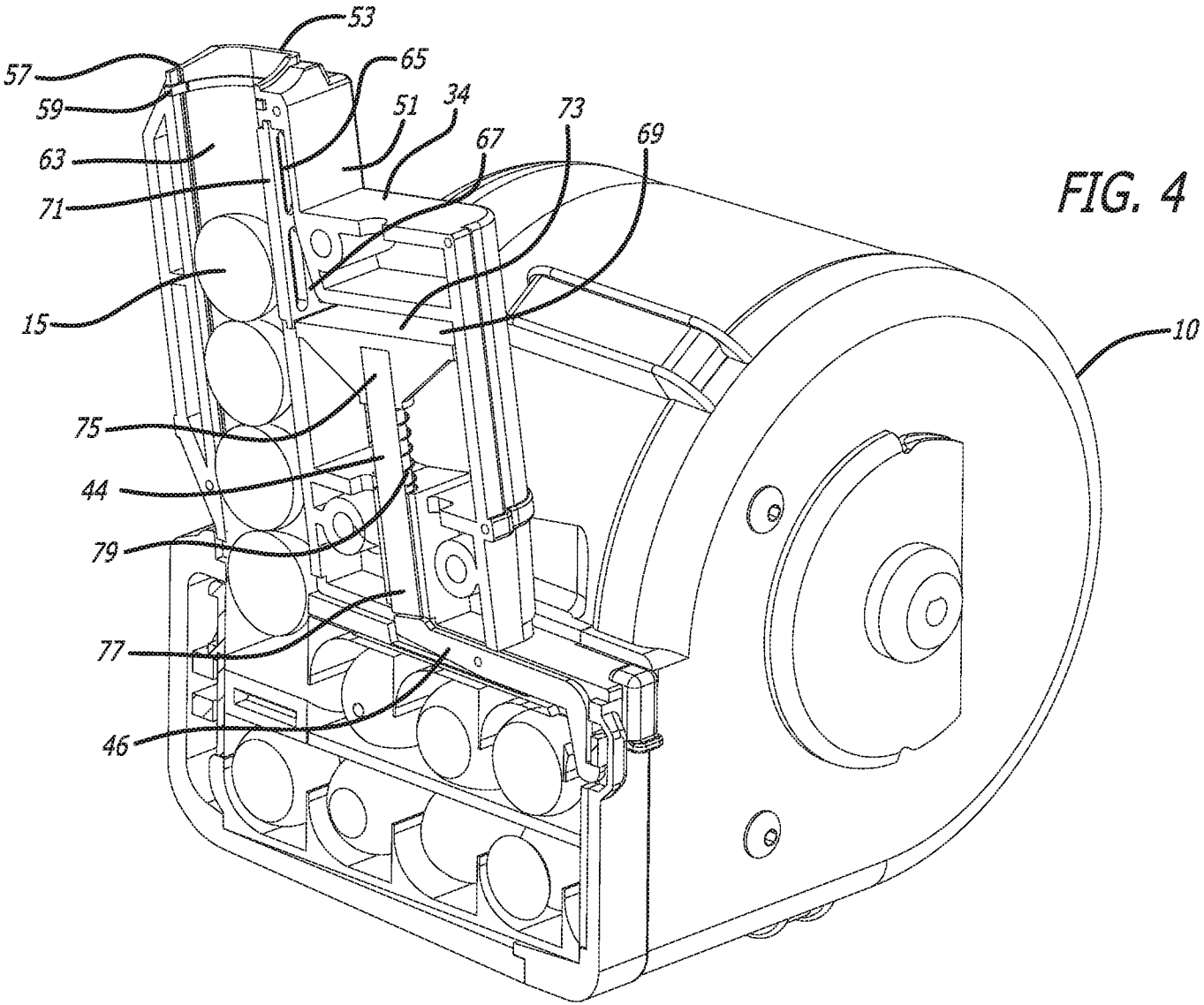
FIG. 4 is a cross-sectional view of the projectile loader and magazine of FIG. 1.
Figure 5:
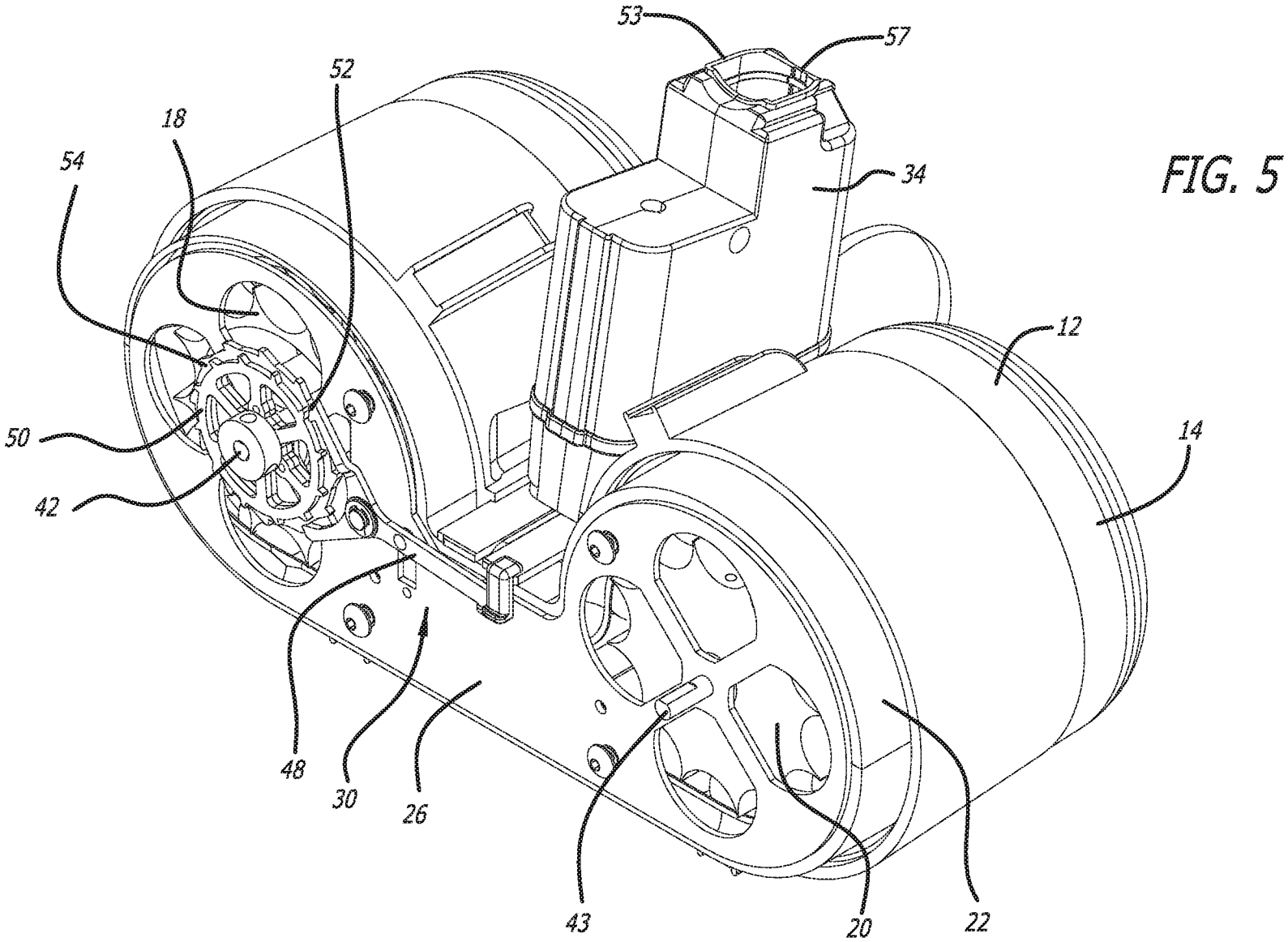
FIG. 5 is a rear perspective view of the projectile loader of FIG. 1 with the rear outer housing removed.

Referring to FIGS. 3 and 4, in one embodiment the magazine 34 comprises a housing 51 and an air actuated actuator 44. In the unactuated position the actuator 44 is positioned in a first position. The housing 51 has a flange 53 that mates with the circumferential perimeter of the barrel 49. Accordingly, as is evident in FIG. 4, the leading and trailing edges 57 of the flange 53 have an arcuate shape. The flange 53 helps to provide a closer seal between the magazine housing 51 and the barrel 49. In one embodiment, the housing 51 also has a plate 59 shaped similar to the cross-sectional geometry of the projectile 15 that is utilized in the loader 10. The plate 59 is preferably provided at a top of the chimney 63 in the housing 51 through which the projectiles 15 move to transfer from the loader 10 to the barrel 49. An opening 65 is provided in the chimney 63 that leads to a pathway 67 in the housing 51 to transfer air to a piston chamber 69. A grate 71 is provided at the opening 65 in the housing 51 to allow air to pass through the opening 65 to the pathway 67, but to prevent the opening 65 from disrupting the flow of projectiles 15 through the chimney 63. As explained above, in one embodiment, the air actuated actuator 44 of the current embodiment receives a contactless pneumatic input. To receive the input, the air actuated actuator 44 has a piston 73 at a first end 75 of the actuator 44. The piston 73 resides in the piston chamber 69 and preferably, the perimeter geometry of the of the piston 73 matches, as closely as possible, the geometry of the wall of the piston chamber 69 so that as little air as possible can pass by the piston 73. A second end 77 of the actuator 44 engages the lower link 46 of the indexing assembly 30 to provide the input to the indexing assembly 30. The actuator 44 also has a spring 79 that biases the actuator 44 away from the lower link 46 and toward the first position of the actuator 44.

Figure 7:
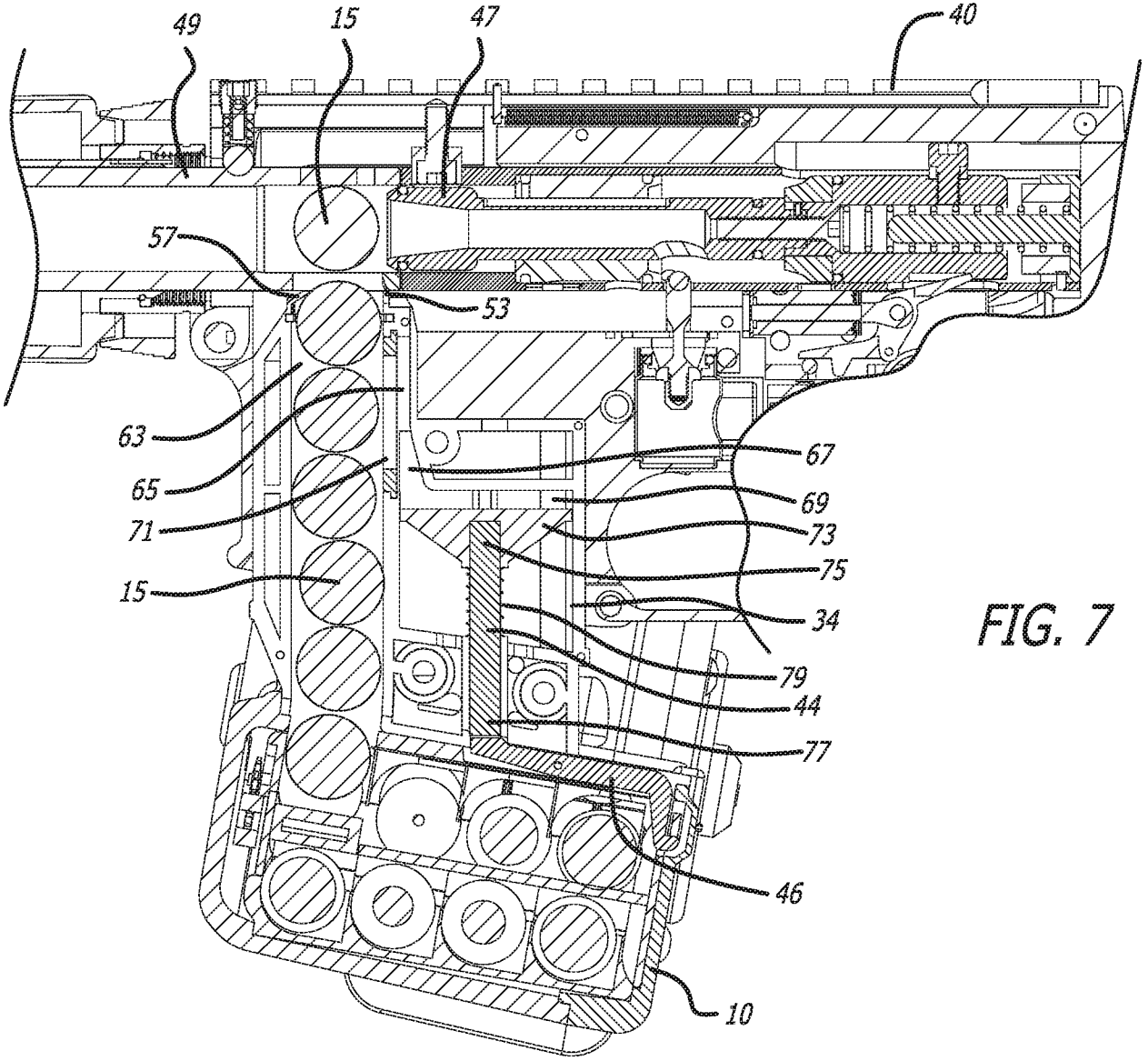
FIG. 7 is a cross-sectional side view of the projectile loader and magazine of FIG. 1 demonstrating a projectile that has been placed into the launcher barrel by the loader.
Figure 8:
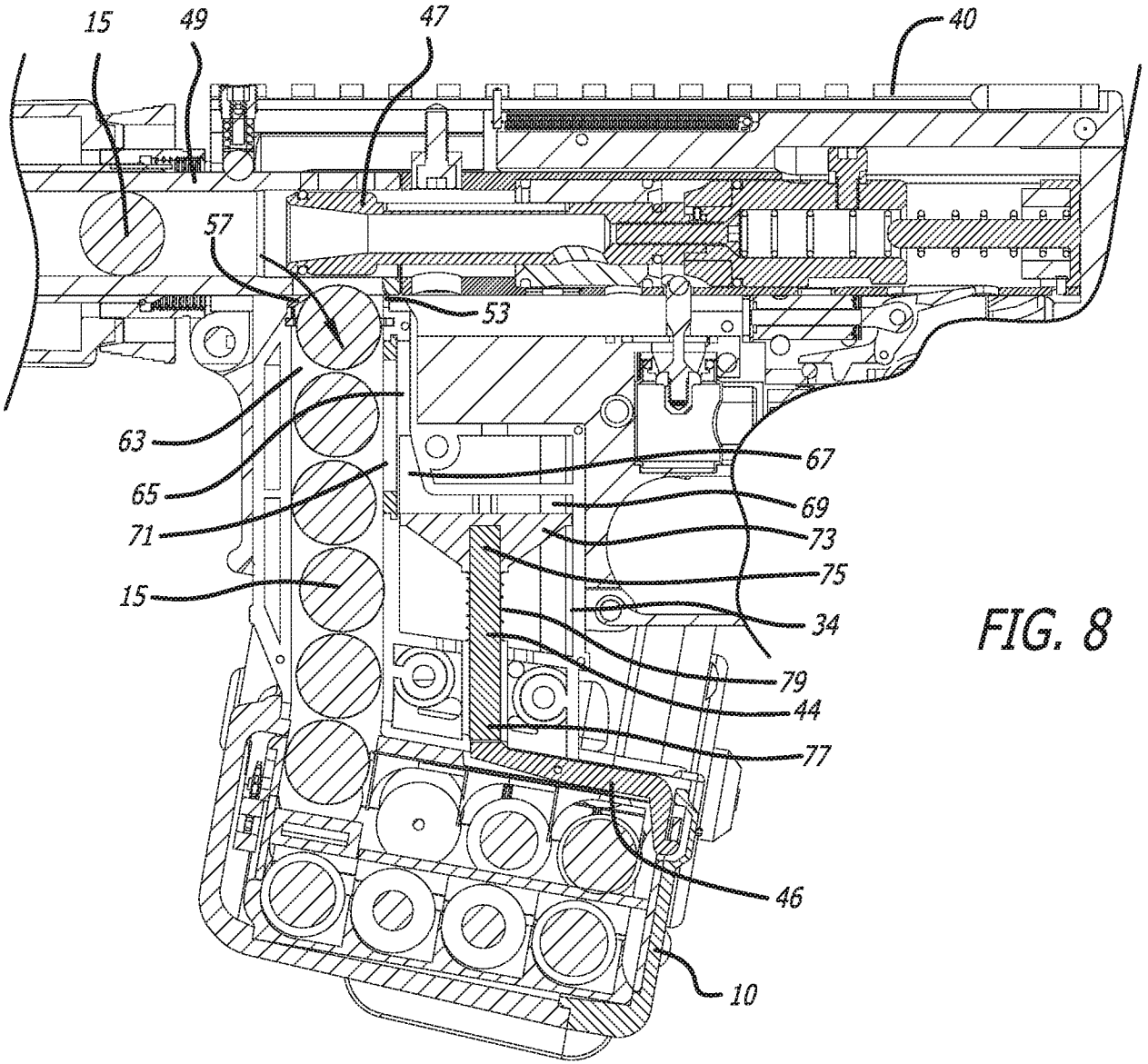
FIG. 8 is a cross-sectional side view of the projectile loader and magazine of FIG. 1 demonstrating the launching of a projectile that was placed in the launcher barrel in FIG. 7.
Figure 9:
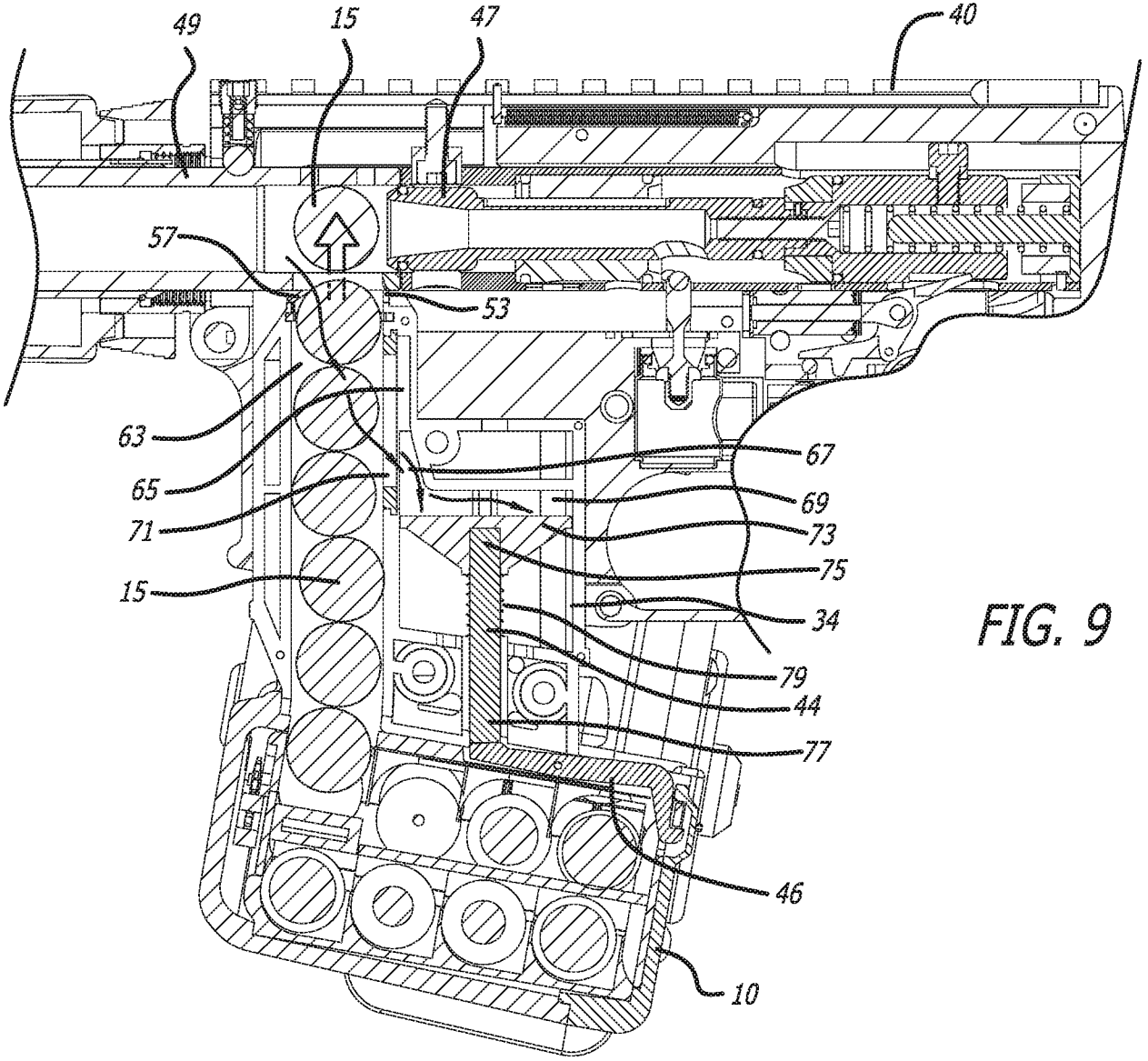
FIG. 9 is a cross-sectional side view of the projectile loader and magazine of FIG. 1 demonstrating the actuation of the indexing assembly to index a projectile into the launcher barrel following the launching of the prior projectile.

Referring to FIG. 7, this drawing illustrates the loader 10 and magazine 44 attached to the launcher 40 and a projectile in the breach of the barrel 49. In FIG. 8 the bolt 47 has moved forward in the barrel 49 and the highly pressurized gas has passed through the bolt 47 and has shot the projectile out of the barrel 49 of the launcher 40. As shown in FIGS. 8 and 9, when the pressurized gas, which may be accelerated at approximately 400 ft/sec, hits the projectile 15, a certain amount of back pressure is created by both the blow back of gas that hits the projectile as well as the blow by of gas from the pressurized gas source. The back pressure forces some of the pressurized gas down the chimney 63 of the magazine 34. And, because of the fluid dynamics involved when a fluid, such as a gas, is forced down a tube, such as the chimney 63, a sufficient amount of pressurized gas will translate through the opening 65 in the chimney 63 and down the air pathway 67 to the piston chamber 69. When the pressurized gas enters the piston chamber 69, as shown in FIG. 9, the pressurized gas will provide a force on the piston 73 to force the piston 73 downward in the piston chamber 69 and thereby push the actuator 44 downwardly. The force may be approximately 1-2 lbs, but may be as high as 4 lbs or more or may be less. When the actuator 44 receives this input from the launcher 40 the actuator 44 moves down to a second position and pushes the lower link 46 of the indexing assembly 30, which operates to actuate the first pawl 48, which advances the outer cog 50 one unit of rotation and the second pawl 52 operates as a stop against the inner cog 54 to prevent opposite rotation of the system. The outer cog 50 is connected to the drive shaft 42 to correspondingly rotate the drive shaft 42 one unit of rotation. Thus, upon receiving an input from the launcher 40, the indexing assembly 30 indexes the drive shaft 42 one unit of rotation. The spring 79 operates to transition the actuator 44 and piston 73 back to the unactuated position. This occurs after each firing of a projectile. Of course, the loader 10 is pre-tensioned via the pre-tensioning mechanism 38 such that the indexing assembly 30 does not necessarily provide the rotation force, but the pre-tensioning of the first and second drive shafts 42, 43 provides the force and the indexing assembly 30 provides the timing and allows for the movement. In a preferred embodiment, as shown in FIGS. 2 and 6, the indexing assembly 30 is located at the second end of the loader 10, and the pre-tensioning assembly 38 is located adjacent the first end of the loader 10, however, the pre-tensioning assembly 38 could easily be located adjacent the second end of the loader 10.

Since the first drive core 18 is connected to the first drive shaft 42, when the first drive shaft 42 is indexed one unit of rotation, the first drive core 18 will correspondingly rotate one unit (i.e., one projectile). As shown in FIGS. 2 and 6, the first drive shaft 42 has a drive gear 56 at the front end of the drive shaft 42. Correspondingly, the second drive shaft 43 has a drive gear 58 at the front end of the second drive shaft 43. A drive mechanism, such as a chain or belt 61 connects drive gear 56 with drive gear 58 such that as the drive gear 56 rotates one unit of rotation with the first drive shaft 42, the drive gear 58 and second drive shaft 43 will rotate a corresponding one unit of rotation. Further, since the second drive core 20 is connected to the second drive shaft 43, when the second drive shaft 43 rotates one unit of rotation, the second drive core 20 will similarly rotate one unit of rotation.

Referring to FIG. 6, in one embodiment the first drive shaft 42 is a two-part drive shaft 42, with a first portion **42*a* connected to the indexing assembly 30 and a second portion 42*b* connected to the drive gear 56. A coupling member 55** joins the first portion 42*a* of the first drive shaft 42 with the second portion 42*b* of the first drive shaft 42. The coupling member 55 operates to dampen or soften the starting and stopping of the first and second drive shafts 42, 43 due to the strong spring force of the pre-tensioning mechanism 38 and the quick indexing of the indexing assembly 30.

The first and second drive cores 18, 20 have a plurality of longitudinal concave receivers 60 about their outer circumference. The concave receivers 60 are designed to receive a variety of shapes of projectiles as shown in FIG. 2. In one embodiment there are twelve concave receivers 60 about the outer circumference of the drive cores 18, 20. Accordingly, each unit of rotation of the drive cores 18, 20 equates to approximately 30° of rotation of the drive cores 18, 20.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

What is claimed is:

1. A magazine for a high capacity loader, comprising:

a magazine housing for holding a plurality of projectiles, the magazine housing having an opening providing access to a projectile chimney, the plurality of projectiles exiting the magazine through the opening in the magazine housing via the projectile chimney;

an aperture in a sidewall of the projectile chimney, the aperture leading to an air pathway;

a piston chamber in fluid communication with the air pathway;

an actuator in the piston chamber, the actuator having a piston at a first end thereof; and, an indexing assembly in the magazine housing, the indexing assembly being driven by the actuator.

2. The magazine of claim 1, wherein the actuator is moveable between a first position and a second position.

3. The magazine of claim 2, wherein the indexing assembly indexes the plurality of projectiles when the actuator is moved to the second position.

4. The magazine of claim 2, further comprising a spring exerting a force on the actuator away from the indexing assembly.

5. The magazine of claim 4, wherein the spring biases the actuator to the first position.

6. The magazine of claim 1, wherein the indexing assembly is connected to a second end of the actuator.

7. The magazine of claim 1, further comprising a grate within the aperture in the sidewall of the projectile chimney.

8. The magazine of claim 1, further comprising a flange extending from the magazine housing, the flange mating with a barrel of a launcher to which the magazine is attached.

9. The magazine of claim 1, wherein the actuator is pneumatically actuated.

10. A magazine for a high capacity loader, comprising:

a magazine housing for holding a plurality of projectiles, the magazine housing having an opening providing access to a projectile chimney, the plurality of projectiles exiting the magazine through the opening in the magazine housing via the projectile chimney;

an aperture in the projectile chimney;

a piston chamber in fluid communication with the aperture; and an air actuator in the piston chamber, the air actuator having a piston at a first end thereof, wherein the air actuator drives an indexing assembly for indexing the plurality of projectiles in the high capacity loader.

11. The magazine of claim 10, wherein the aperture is provided in a sidewall of the projectile chimney.

12. The magazine of claim 11, further comprising a grate in the aperture.

13. The magazine of claim 10, wherein the air actuator is pneumatically actuated.

14. The magazine of claim 10, wherein the indexing assembly is connected to a second end of the air actuator.

15. The magazine of claim 10, wherein the air actuator is moveable between a first position and a second position.

16. The magazine of claim 10, further comprising a spring exerting a force on the air actuator to bias the actuator to the first position.

17. A magazine for a high capacity loader, comprising:

a magazine housing for holding a plurality of projectiles, the magazine housing having an opening providing access to a projectile chimney, the plurality of projectiles exiting the magazine through the opening in the magazine housing via the projectile chimney;

an aperture leading to a piston chamber;

a pneumatically actuated actuator in the piston chamber, the actuator having a piston at a first end thereof;

an indexing assembly in the magazine housing, the indexing assembly being driven by the actuator; and, a first drive core indexed by the indexing assembly, wherein the high capacity loader is adapted to be connected to a launcher.

18. The magazine of claim 17, wherein the aperture is provided in a sidewall of the projectile chimney.

19. The magazine of claim 17, further comprising a second drive core rotationally connected to the first drive core and indexed by the indexing assembly.

20. The magazine of claim 17, further comprising a spring exerting a force on the actuator to bias the actuator away from the indexing assembly.

* * * * *